US009213256B2

(12) United States Patent
Okabe et al.

(10) Patent No.: US 9,213,256 B2
(45) **Date of Patent: *Dec. 15, 2015**

(54) DEVELOPER CARTRIDGE HAVING DEVELOPING ROLLER

(71) Applicant: Brother Kogyo Kabushiki Kaisha, Nagoya-shi, Aichi-ken (JP)

(72) Inventors: Yasushi Okabe, Nagoya (JP); Hideshi Nishiyama, Owariasahi (JP); Fumikazu Sato, Konan (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/577,890

(22) Filed: Dec. 19, 2014

(65) Prior Publication Data

US 2015/0104223 A1 Apr. 16, 2015

Related U.S. Application Data

(63) Continuation of application No. 13/599,457, filed on Aug. 30, 2012, now Pat. No. 8,918,019.

(30) Foreign Application Priority Data

Aug. 31, 2011 (JP) ..... 2011-190030

(51) Int. Cl.
*G03G 15/04* (2006.01)
*G03G 15/08* (2006.01)
(Continued)

(52) U.S. Cl.
CPC ..... *G03G 15/0808* (2013.01); *G03G 15/0163* (2013.01); *G03G 21/1647* (2013.01); *G03G 21/1857* (2013.01); *G03G 2215/0141* (2013.01)

(58) Field of Classification Search
USPC ..... 399/107, 110, 111, 119, 120
See application file for complete search history.

(56) References Cited

U.S. PATENT DOCUMENTS 7,599,640 B2 10/2009 Sato
7,643,770 B2 * 1/2010 Sato et al. ..... 399/90
(Continued)

FOREIGN PATENT DOCUMENTS

EP 2194431 A2 6/2010
JP H07-228382 A 8/1995
(Continued)

OTHER PUBLICATIONS

Extended EP Search Report, including European Search Opinion, mailed Jan. 15, 2013, EP Appln. 12182297.7-2216.
(Continued)

*Primary Examiner* — Hoan Tran
(74) *Attorney, Agent, or Firm* — Banner & Witcoff, Ltd.

(57) ABSTRACT

The developer cartridge includes a developing roller, a supply roller, a gear, a first intermediate gear, a second intermediate gear, a developing roller gear, and a supply roller gear. The supply roller is in contact with the developing roller. The gear is configured to receive a drive force from an outside. The first intermediate gear is provided to a supply roller shaft such that the first intermediate gear is rotatable relative to the supply roller shaft. The developing roller gear is provided to a developing roller shaft such that the developing roller gear is unrotatable relative to the developing roller shaft. The developing roller gear is engaged with the second intermediate gear. The supply roller gear is provided to the supply roller shaft such that the supply roller gear is unrotatable relative to the supply roller shaft. The supply roller gear is engaged with the second intermediate gear.

11 Claims, 5 Drawing Sheets

(51) Int. Cl.

| | |
|---|---|
| ***G03G 21/16*** | (2006.01) |
| ***G03G 21/18*** | (2006.01) |
| ***G03G 15/01*** | (2006.01) |

(56) References Cited

U.S. PATENT DOCUMENTS

| | | | | |
|---|---|---|---|---|
| 7,751,728 | B2 | 7/2010 | Okabe | |
| 7,813,673 | B2 | 10/2010 | Sato | |
| 7,941,072 | B2 | 5/2011 | Ishikawa et al. | |
| 7,957,669 | B2 | 6/2011 | Ishii et al. | |
| 7,970,315 | B2 | 6/2011 | Sato | |
| 7,978,997 | B2 * | 7/2011 | Tokuda | 399/90 |
| 8,009,996 | B2 | 8/2011 | Ishikawa | |
| 2006/0072936 | A1 | 4/2006 | Numagami et al. | |
| 2007/0059038 | A1 * | 3/2007 | Shiraki | 399/119 |
| 2007/0122176 | A1 | 5/2007 | Sato | |
| 2007/0196114 | A1 | 8/2007 | Okabe | |
| 2009/0169255 | A1 | 7/2009 | Sato | |
| 2010/0329736 | A1 | 12/2010 | Sato | |
| 2011/0222916 | A1 | 9/2011 | Sato | |

FOREIGN PATENT DOCUMENTS

| | | | |
|---|---|---|---|
| JP | H10-171331 | A | 6/1998 |
| JP | 2001-227595 | A | 8/2001 |
| JP | 2002-278258 | A | 9/2002 |
| JP | 2007148287 | A | 6/2007 |
| JP | 2007-219294 | A | 8/2007 |
| JP | 2009162906 | A | 7/2009 |

OTHER PUBLICATIONS

JP Office Action mailed Jul. 9, 2013, JP Appln. 2011-190030, English Translation.

CN Notification of the First Office Action mailed Mar. 4, 2014, CN Appln. 201210324509.2, English translation.

JP Office Action mailed Mar. 18, 2014, JP Appln. 2011-190030, English Translation.

Aug. 5, 2014—(JP) Decision to Rejection—App 2011-190030—Eng Tran.

Oct. 31, 2014—(CN) Notification of the Second Office Action—App 201210324509.2—Eng tran.

* cited by examiner

DEVELOPER CARTRIDGE HAVING DEVELOPING ROLLER

CROSS REFERENCE TO RELATED APPLICATION

This application is a continuation of U.S. application Ser. No. 13/599,457 filed Aug. 30, 2012, which claims priority from Japanese Patent Application No. 2011-190030 filed Aug. 31, 2011. The entire contents of the above noted applications are incorporated herein by reference.

TECHNICAL FIELD

The present invention relates to a developer cartridge that mounts in an image-forming device employing an electrophotographic system.

BACKGROUND

An electrophotographic printer known in the art has drum cartridges respectively provided with photosensitive drums, and developer cartridges that supply toner to the corresponding photosensitive drums. One type of developer cartridge known in the art for use in this type of printer includes a developing roller for carrying toner, and a supply roller for supplying toner onto the developing roller.

Each developer cartridge includes an input gear into which an external drive force is inputted, a supply-roller gear for driving the corresponding supply roller by the drive force received from the input gear, and a developing-roller gear for driving the corresponding developing roller by the drive force transmitted from the input gear via the supply-roller gear. In other words, the drive force inputted into the input gear is transmitted to the developing-roller gear through the supply-roller gear.

SUMMARY

However, in a developer cartridge having the structure described above, the supply roller rotates against a frictional force generated between the developing roller and supply roller and, thus, rotates while sliding against the developing roller at a torque greater than the frictional force. Consequently, the rotation of the supply roller is prone to variation in speed and may be unstable. Accordingly, the rotation of the developing roller may also become unstable when the force for driving the developing roller is transmitted to the developing-roller gear through the supply-roller gear.

The rotation of the developing roller can be stabilized by transmitting the drive force from the input gear separately to the supply roller and the developing roller. However, this configuration requires two separate paths for transmitting the drive force from the input gear to the supply roller and the developing roller, respectively, and is not conducive to conserving space.

Therefore, it is an object of the present invention to provide a developer cartridge capable of conserving space while achieving stable rotation of the developing roller.

In order to attain the above and other objects, the invention provides a developer cartridge. The developer cartridge may include a developing roller, a supply roller, a gear, a first intermediate gear, a second intermediate gear, a developing roller gear, and a supply roller gear. The developing roller may include a developing roller shaft extending in a first direction. The supply roller may include a supply roller shaft. The supply roller may be in contact with the developing roller.

The gear may be configured to receive a drive force from an outside. The first intermediate gear may be provided to the supply roller shaft such that the first intermediate gear is rotatable relative to the supply roller shaft. The first intermediate gear may be engaged with the gear. The second intermediate gear may be engaged with the first intermediate gear. The developing roller gear may be provided to the developing roller shaft such that the developing roller gear is unrotatable relative to the developing roller shaft. The developing roller gear may be engaged with the second intermediate gear. The supply roller gear may be provided to the supply roller shaft such that the supply roller gear is unrotatable relative to the supply roller shaft. The supply roller gear may be engaged with the second intermediate gear.

BRIEF DESCRIPTION OF THE DRAWINGS

The particular features and advantages of the invention as well as other objects will become apparent from the following description taken in connection with the accompanying drawings, in which:

FIG. 2(*b*) is a side view showing the developer cartridge when a gear cover is removed therefrom according to the first embodiment;

DETAILED DESCRIPTION

1. Overall Structure of a Printer

Figure 1:
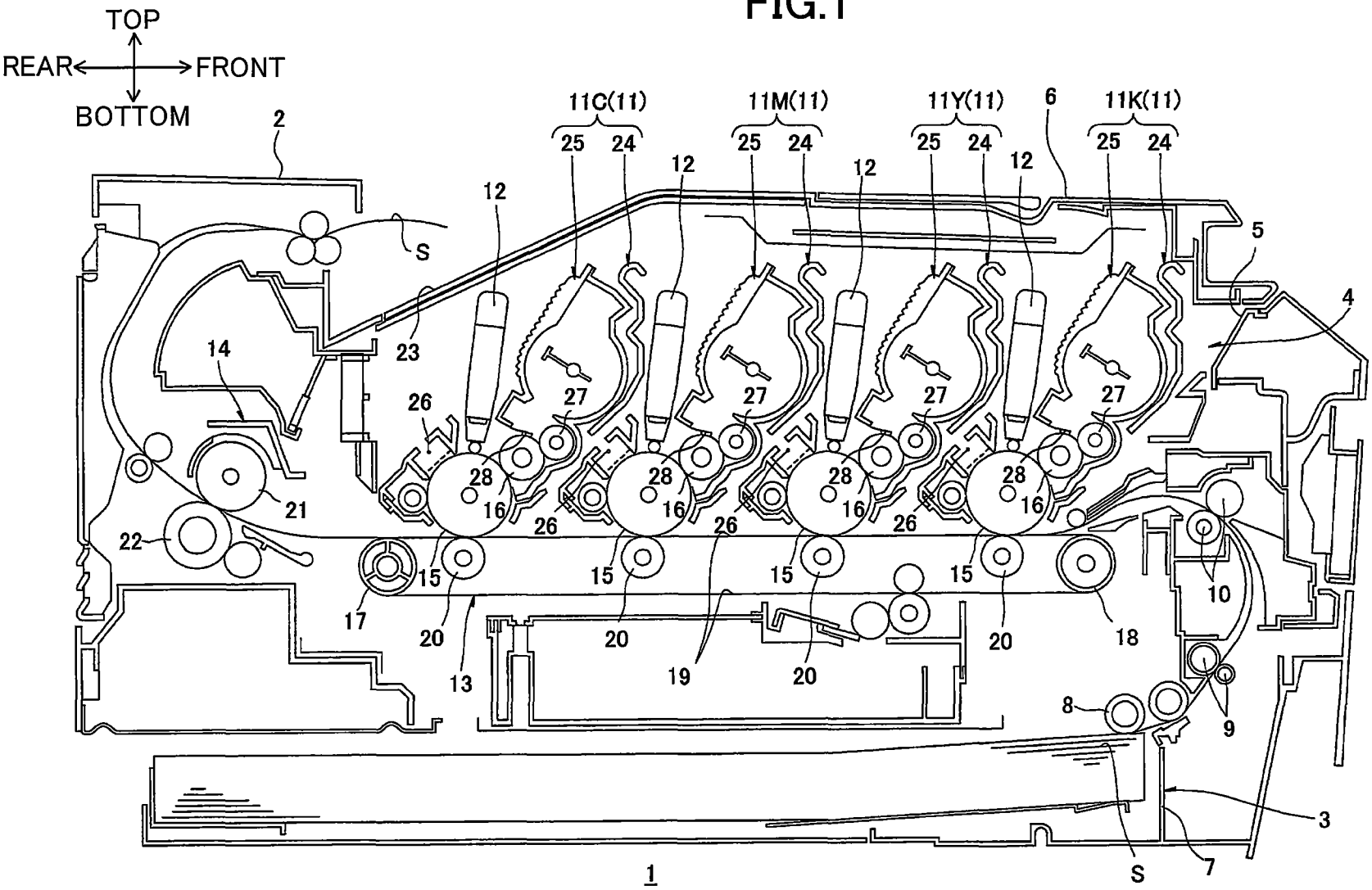
FIG. 1 is a central cross-sectional view showing a printer provided with developer cartridges according to a first embodiment of the present invention.

A printer 1 shown in FIG. 1 is a horizontal direct tandem-type color printer.

Directions with respect to the printer 1 in the following description will be given under the assumption that the printer 1 is resting on a level surface, and the right side of the printer 1 in FIG. 1 will be considered the front side while the left side will be considered the rear side. Left and right sides of the printer 1 will be determined based on the perspective of a user facing the front of the printer 1. In other words, the near side of the printer 1 in FIG. 1 will be considered the left side, while the far side will be considered the right side.

Directions with respect to a developer cartridge 25 in the following description will be given under the assumption that the developer cartridge 25 is resting on a level surface, with a bottom wall 35 of the developer cartridge 25 positioned on the bottom (see FIG. 2). Further, the side of the developer cartridge 25 supporting a developing roller 16 will be considered the rear side, while the side supporting a thickness-regulating blade 28 will be considered the upper side.

The printer 1 includes a main casing 2, a sheet-feeding unit 3 for feeding sheets S to be printed, and an image-forming unit 4 for forming images on the sheets S supplied by the sheet-feeding unit 3.

(1) Main Casing

The main casing 2 is box-shaped and substantially rectangular in a side view. The main casing 2 accommodates the sheet-feeding unit 3 and the image-forming unit 4. An access opening 5 is formed in the top portion of the main casing 2 for mounting process cartridges 11 (described later) in the main casing 2 or removing the process cartridges 11 therefrom. A top cover 6 is pivotably disposed on the top of the main casing 2. The top cover 6 is capable of pivoting about its rear end to expose or cover the access opening 5.

(2) Sheet-Feeding Unit

The sheet-feeding unit 3 includes a paper tray 7 for accommodating sheets S. The paper tray 7 is removably mounted in the bottom section of the main casing 2. The sheet-feeding unit 3 also includes a pickup roller 8, and a pair of feeding rollers 9 both disposed above the front edge of the paper tray 7; and a pair of registration rollers 10 disposed above the feeding rollers 9.

The pickup roller 8 and the feeding rollers 9 rotate to pick up the sheets S accommodated in the paper tray 7 and feed the sheets S one sheet at a time toward the registration rollers 10. The registration rollers 10 convey the sheets toward the image-forming unit 4 (between photosensitive drums 15 and a conveying belt 19 described later) at a prescribed timing.

(3) Image-Forming Unit

The image-forming unit 4 includes four each of process cartridges 11 and LED units 12 corresponding to the four colors used in the printer 1; a transfer unit 13; and a fixing unit 14.

(3-1) Process Cartridges

The process cartridges 11 are detachably mounted in the main casing 2 at positions above the sheet-feeding unit 3 so as to be arranged parallel to one another and spaced at intervals in the front-rear direction. More specifically, the process cartridges 11 include, in order from front to rear, a black process cartridge 11K, a yellow process cartridge 11Y, a magenta process cartridge 11M, and a cyan process cartridge 11C.

Each process cartridge 11 includes a drum cartridge 24, and a developer cartridge 25 detachably mounted in the drum cartridge 24.

The drum cartridge 24 is provided with a photosensitive drum 15, and a Scorotron charger 26. The photosensitive drum 15 has a cylindrical shape and is oriented with its axis aligned in the left-right direction. The photosensitive drum 15 is rotatably disposed in the drum cartridge 24. The Scorotron charger 26 is provided on the rear side of the corresponding photosensitive drum 15. The Scorotron charger 26 confronts the photosensitive drum 15 with a gap therebetween.

The developer cartridge 25 is provided with a developing roller 16. The developing roller 16 has a metal developing-roller shaft 30 aligned in the left-right direction (axial direction) as shown in FIG. 2. The developing roller 16 is provided in the rear end of the developer cartridge 25, with its peripheral surface exposed through the rear side of the same and in contact with the upper front side of the photosensitive drum 15. The developing roller 16 rotates about a central axis A1 of the developing-roller shaft 30 (see FIG. 3).

Each developer cartridge 25 also includes a supply roller 27 for supplying toner to the developing roller 16, and a thickness-regulating blade 28 for regulating the thickness of toner carried on the developing roller 16. The upper section of the developer cartridge 25 serves to accommodate toner.

The supply roller 27 includes a metal supply-roller shaft 29 oriented in the left-right direction and is positioned to contact the upper front side of the developing roller 16. The supply roller 27 rotates about a central axis A2 of the supply-roller shaft 29 (see FIG. 3). The thickness-regulating blade 28 contacts the upper front side of the developing roller 16.

(3-2) LED Units

Each LED unit 12 is disposed on the upper rear side of the corresponding process cartridge 11 so as to face the top of the corresponding photosensitive drum 15. The LED unit 12 functions to expose the surface of the corresponding photosensitive drum 15 to light based on prescribed image data.

(3-3) Transfer Unit

The transfer unit 13 is disposed above the sheet-feeding unit 3 and below the process cartridges 11 and is oriented in the front-rear direction. The transfer unit 13 includes a drive roller 17 and a follow roller 18 arranged parallel to each other and separated in the front-rear direction; a conveying belt 19 placed around the drive roller 17 and follow roller 18 such that its upper portion opposes and contacts the photosensitive drums 15 from below; and four transfer rollers 20 disposed at positions confronting the corresponding photosensitive drums 15 with the upper portion of the conveying belt 19 interposed therebetween.

When the drive roller 17 is driven to rotate, the conveying belt 19 circulates so that the upper portion of the conveying belt 19 that contacts each of the photosensitive drums 15 moves in a rearward direction.

(3-4) Fixing Unit

The fixing unit 14 is disposed on the rear side of the transfer unit 13. The fixing unit 14 includes a heating roller 21, and a pressure roller 22 that contacts the heating roller 21 with pressure.

(4) Image-Forming Operation

Toner in the developer cartridge 25 is supplied onto the supply roller 27, which in turn supplies toner to the developing roller 16. The toner is positively tribocharged between the supply roller 27 and developing roller 16. The thickness-regulating blade 28 regulates the thickness of toner supplied to the developing roller 16 as the developing roller 16 rotates, maintaining the layer of toner carried on the surface of the developing roller 16 at a thin uniform thickness.

In the meantime, the Scorotron charger 26 applies a uniform charge to the surface of the corresponding photosensitive drum 15 as the photosensitive drum 15 rotates. The corresponding LED unit 12 subsequently irradiates light on the surface of the photosensitive drum 15, forming an electrostatic latent image on the surface based on image data. Next, the toner carried on the surface of the developing roller 16 is supplied to the latent image formed on the surface of the photosensitive drum 15, developing the latent image into a toner image.

At the same time, a sheet S supplied from the transfer unit 13 onto the conveying belt 19 is conveyed rearward by the conveying belt 19. The toner images of all four colors formed on the photosensitive drums 15 are sequentially superimposed onto the sheet S as the sheet S passes between the photosensitive drums 15 and transfer rollers 20 (transfer positions) to form a color image on the sheet S.

The color image transferred onto the sheet S in the transfer unit 13 is subsequently fixed to the sheet S by heat and pressure as the sheet S passes between the heating roller 21 and pressure roller 22 in the fixing unit 14.

Thereafter, the sheet S is conveyed along a U-shaped path that curves upward and forward and then is discharged onto a discharge tray 23 provided on the top cover 6.

2. Developer Cartridges

Figure 2A:
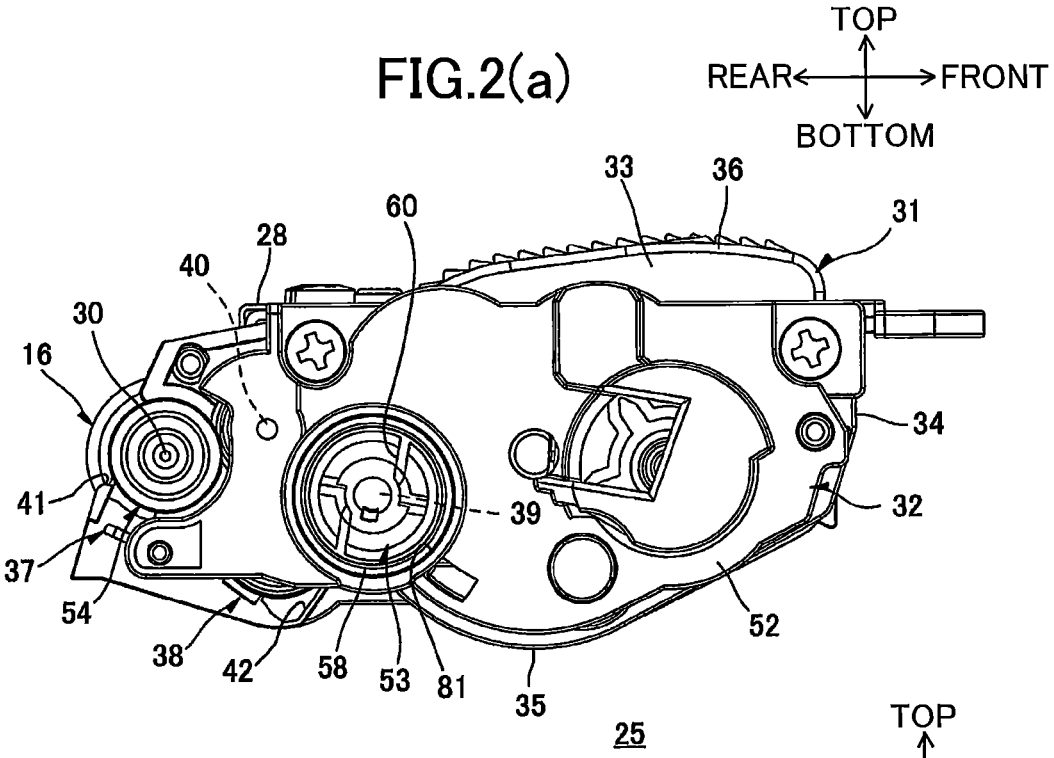
FIG. 2(*a*) is a side view showing the developer cartridge according to the first embodiment.
Figure 2B:
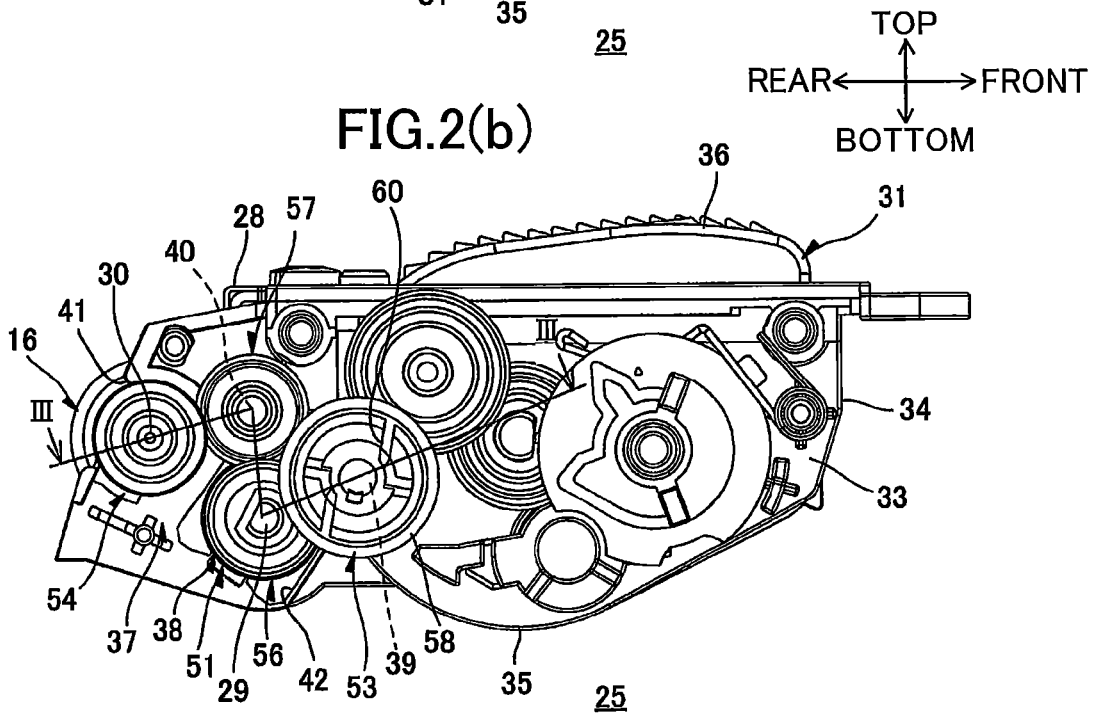

As shown in FIGS. 2 (*a*), 2(*b*), and 3, each developer cartridge 25 has a cartridge frame 31, and a drive unit 32 disposed on the left side of the cartridge frame 31.

(1) Cartridge Frame

The cartridge frame 31 has a general box shape and is elongated in the left-right direction and open on the rear side. The cartridge frame 31 is integrally configured of a pair of left and right side walls 33, a front wall 34, a bottom wall 35, and a top wall 36.

The side walls 33 are generally rectangular in a side view and elongated in the vertical and front-rear directions. The side walls 33 are arranged parallel to each other and are spaced apart in the left-right direction. Each of the side walls 33 is provided with a developing-roller support part 37 for supporting the developing-roller shaft 30, and a supply-roller support part 38 for supporting the supply-roller shaft 29.

The developing-roller support part 37 is provided on the rear end of the side wall 33. A shaft insertion hole 41 is formed in the developing-roller support part 37 for receiving the developing-roller shaft 30. The shaft insertion hole 41 penetrates the side wall 33 to form a general C-shape in a side view that is open on the rear side. The diameter of the shaft insertion hole 41 is larger than the outer diameter of the developing-roller shaft 30. The opening formed in the rear side of the shaft insertion hole 41 has a vertical dimension greater than the outer diameter of the developing-roller shaft 30. The left and right ends of the developing-roller shaft 30 are inserted into the shaft insertion holes 41 formed in respective developing-roller support parts 37 and are supported in the developing-roller support parts 37 via bearing members (not shown). Note that the left end of the developing-roller shaft 30 protrudes out of the shaft insertion hole 41 on the left side of the left side wall 33.

The supply-roller support part 38 is provided on the lower front side of the corresponding developing-roller support part 37. A shaft insertion hole 42 is formed in the supply-roller support part 38 for receiving the supply-roller shaft 29. The shaft insertion hole 42 is generally rectangular in a side view and penetrates the side wall 33. The length of each side forming the rectangular shaft insertion hole 42 is greater than the outer diameter of the supply-roller shaft 29. The left and right ends of the supply-roller shaft 29 are inserted through the shaft insertion holes 42 formed in the corresponding supply-roller support parts 38 and are supported in the supply-roller support parts 38 via bearing members (not shown). Note that the left end of the supply-roller shaft 29 protrudes out of the shaft insertion hole 42 on the left side of the left side wall 33.

The left side wall 33 further includes an input-gear support part 39 for supporting an input gear 53 (described later), and a second-intermediate-gear support part 40 for supporting a second intermediate gear 57 (described later).

The input-gear support part 39 is disposed diagonally above and forward of the shaft insertion hole 42. The input-gear support part 39 is generally columnar in shape, extending leftward from the left side wall 33.

The second-intermediate-gear support part 40 is disposed above the shaft insertion hole 42 and forward of the shaft insertion hole 41. The second-intermediate-gear support part 40 is generally columnar in shape and extends leftward from the left side wall 33.

The front wall 34 extends in the left-right direction, bridging the front edges of the side walls 33.

The bottom wall 35 extends in the left-right direction, bridging the bottom edges of the side walls 33 and connecting to the bottom edge of the front wall 34.

The top wall 36 connects to the top edges of the side walls 33 on the front portion thereof, and the top edge of the front wall 34. The top wall 36 has a flat plate shape that is generally rectangular in a plan view. The thickness-regulating blade 28 is disposed on the rear edge of the top wall 36 so as to contact the top of the developing roller 16.

(2) Drive Unit

As shown in FIGS. 2 (*a*), 2(*b*), and 3, the drive unit 32 includes a gear train 51, and a gear cover 52.

(2-1) Gear Train

As shown in FIGS. 2 (*a*), 2(*b*), and 3, the gear train 51 is configured of an input gear 53, a first intermediate gear 56, a second intermediate gear 57, a developing-roller gear 54, and a supply-roller gear 55.

The input gear 53 is integrally provided with a coupling part 58, and a gear part 59. The coupling part 58 constitutes the left portion of the input gear 53 and is generally columnar in shape elongated in the left-right direction. A fitting recess 60 is formed in the left endface of the coupling part 58 as shown in FIGS. 2(*a*) and 2(*b*).

The fitting recess 60 is recessed rightward in the left surface of the coupling part 58 and extends along a radial direction of the coupling part 58 so as to form an elongate hole that narrows in its radial center when viewed from the side. When the developer cartridge 25 is mounted in the main casing 2, the distal end of a body-side coupling (not shown) provided in the main casing 2 is inserted into the fitting recess 60 so that the body-side coupling and the fitting recess 60 cannot rotate relative to each other. A drive force is inputted from the main casing 2 via the body-side coupling.

The gear part 59 constitutes the right portion of the input gear 53. The gear part 59 is connected to the right side of the coupling part 58 and shares its central axis with the coupling part 58. The gear part 59 is generally columnar in shape and has a smaller diameter than the coupling part 58. Gear teeth are formed on the outer peripheral surface of the gear part 59. The input gear 53 is supported via the gear part 59 and cannot rotate relative to the input-gear support part 39.

The first intermediate gear 56 is disposed on the left end of the supply-roller shaft 29 and is separated from the left side of the left side wall 33. The first intermediate gear 56 is freely rotatable relative to the supply-roller shaft 29. The first intermediate gear 56 has a general disc shape, with a thick left-right dimension. Gear teeth are formed on the outer peripheral surface of the first intermediate gear 56. The first intermediate gear 56 engages with the gear part 59 of the input gear 53 from the lower rear side thereof.

The second intermediate gear 57 is integrally provided with a large-diameter part 61 and a small-diameter part 62. The large-diameter part 61 constitutes the right portion of the second intermediate gear 57 and is generally cylindrical in shape elongated in the left-right direction. Gear teeth are formed on the outer peripheral surface of the large-diameter part 61. The small-diameter part 62 is generally cylindrical in shape and extends leftward from the left surface of the large-diameter part 61. The small-diameter part 62 shares its central axis with the large-diameter part 61. Gear teeth are formed on the outer peripheral surface of the small-diameter part 62.

The second intermediate gear 57 is supported on the second-intermediate-gear support part 40 and is freely rotatable relative to the same. The small-diameter part 62 is engaged with the top of the first intermediate gear 56 (see FIG. 2(*b*)).

The supply-roller gear 55 is disposed between the left side wall 33 and the first intermediate gear 56. The supply-roller gear 55 is generally disc-shaped, with a thick left-right dimension. The supply-roller gear 55 is narrower and smaller in diameter than the first intermediate gear 56. A supply-roller-shaft fitting hole 71 having a generally D-shaped cross section penetrates the center of the supply-roller gear 55. Gear teeth are formed on the outer peripheral surface of the supply-roller gear 55.

A support part 72 having a generally D-shaped cross section is formed on the supply-roller shaft 29. The supply-roller gear 55 is fitted over the support part 72 at the supply-roller-shaft fitting hole 71 (fitted from radially outside the supply-roller shaft 29) so as to be incapable of rotating relative to the support part 72. Accordingly, the supply-roller gear 55 coaxially rotates together with the supply-roller shaft 29. The supply-roller gear 55 is engaged in the bottom side of the large-diameter part 61 constituting the second intermediate gear 57.

Figure 3:
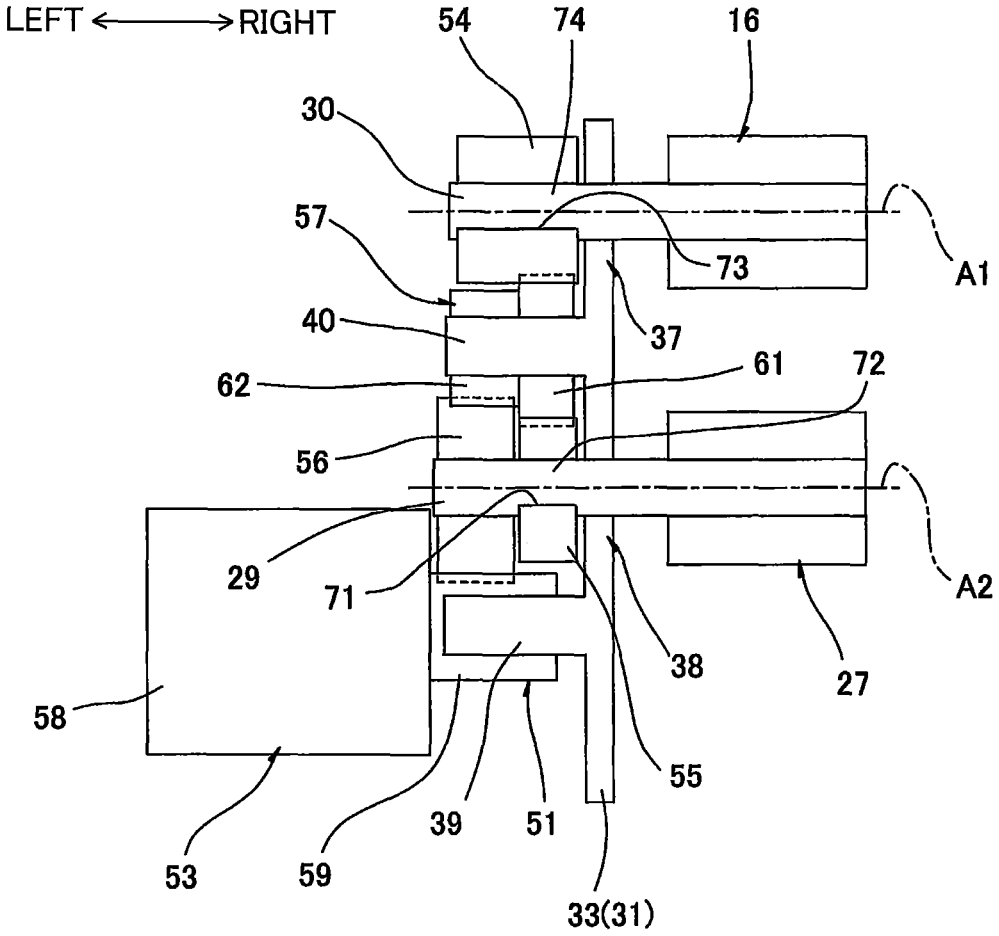
FIG. 3 is an explanatory diagram illustrating a drive transmission of the developer cartridge taking along a line III-III of FIG. 2(*b*) according to the first embodiment.

The developing-roller gear 54 is disposed on the left side of the left side wall 33 as shown in FIG. 3. The developing-roller gear 54 is generally disc-shaped with a thick left-right dimension. A developing-roller-shaft fitting hole 73 having a generally D-shaped cross section penetrates the center of the developing-roller gear 54. Gear teeth are formed on the outer peripheral surface of the developing-roller gear 54.

A support part 74 having a generally D-shaped cross section is formed on the developing-roller shaft 30. The developing-roller gear 54 is fitted over the support part 74 at the developing-roller-shaft fitting hole 73 (fitted from radially outside the developing-roller shaft 30) and is incapable of rotating relative to the support part 74. Accordingly, the developing-roller gear 54 coaxially rotates together with the developing-roller shaft 30. The developing-roller gear 54 engages with the rear side of the large-diameter part 61 constituting the second intermediate gear 57.

(2-2) Gear Cover

As shown in FIG. 2(*a*), the gear cover 52 is generally rectangular in a side view and elongated in the front-rear direction. The gear cover 52 is formed with front-rear and vertical dimensions sufficient for covering all of the gear cover 52, the input gear 53, the first intermediate gear 56, the second intermediate gear 57, and the supply-roller gear 55.

A coupling exposure opening 81 is also formed in the gear cover 52. The coupling exposure opening 81 has a generally circular shape in a side view and penetrates the left wall of the gear cover 52 in approximately the front-rear center thereof. The coupling exposure opening 81 functions to expose the left surface of the coupling part 58 constituting the input gear 53.

The gear cover 52 is fastened to the left side wall 33 with screws so as to cover the input gear 53 (excluding the left surface of the coupling part 58), the first intermediate gear 56, the second intermediate gear 57, and the supply-roller gear 55, while the left surface of the coupling part 58 is exposed through the coupling exposure opening 81.

3. Drive Transmission in the Developer Cartridge

Next, the transmission of a drive force from the input gear 53 to the supply roller 27 and the developing roller 16 will be described with reference to FIG. 3. When the process cartridge 11 is mounted in the main casing 2, the distal end of the body-side coupling (not shown) provided in the main casing 2 is inserted into the fitting recess 60 of the input gear 53 so that the body-side coupling does not rotate relative to the input gear 53. At this time, a drive force is inputted from the main casing 2 into the input gear 53 via the body-side coupling, driving the input gear 53 to rotate. The drive force rotating the input gear 53 is transmitted to the first intermediate gear 56 via the gear part 59, driving the first intermediate gear 56 to rotate about the central axis A2 of the supply-roller shaft 29. At this time, the first intermediate gear 56 rotates relative to the supply-roller shaft 29. In other words, the drive force is not transmitted from the first intermediate gear 56 to the supply-roller shaft 29.

When the first intermediate gear 56 is driven to rotate, the drive force is transmitted to the small-diameter part 62 of the second intermediate gear 57 engaged with the first intermediate gear 56, driving the second intermediate gear 57 to rotate. The drive force is in turn transmitted to the developing-roller gear 54 and supply-roller gear 55 engaged with the large-diameter part 61 of the second intermediate gear 57, rotating both the developing-roller gear 54 and supply-roller gear 55. Consequently, the developing-roller gear 54 inputs a drive force into the developing-roller shaft 30 to rotate the developing roller 16. Similarly, the supply-roller gear 55 inputs a drive force into the supply-roller shaft 29 for rotating the supply roller 27.

4. Operational Advantages (1) As described with reference to FIG. 3, the developer cartridge 25 of the embodiment transmits a drive force from the input gear 53 to the supply roller 27 sequentially via the first intermediate gear 56, the second intermediate gear 57, and the supply-roller gear 55, while simultaneously transmitting the drive force to the developing roller 16 sequentially via the first intermediate gear 56, the second intermediate gear 57, and the developing-roller gear 54. Accordingly, the developer cartridge 25 can transmit the drive force from the input gear 53 to the developing roller 16 without passing through the supply roller 27, thereby stabilizing the rotation of the developing roller 16.

Further, both the first intermediate gear 56 and the supply-roller gear 55 rotate about the central axis A2 of the supply-roller shaft 29. Accordingly, the first intermediate gear 56 can be arranged more efficiently so as to overlap the supply-roller gear 55 in the left-right direction.

(2) According to the developer cartridge 25 described with reference to FIG. 3, the supply-roller gear 55 is engaged with the supply-roller shaft 29 so as to be incapable of rotating relative to the same, and the first intermediate gear 56 is engaged with the supply-roller shaft 29 so as to be capable of rotating relative to the same. Therefore, the supply-roller gear 55 can reliably input a drive force into the supply-roller shaft 29 of the supply roller 27.

In addition, since the first intermediate gear 56 is capable of freely rotating relative to the supply-roller shaft 29, the first intermediate gear 56 can be rotated without causing the supply-roller shaft 29 to rotate. As a result, the supply-roller gear 55 and the first intermediate gear 56 can be provided on the supply-roller shaft 29 to conserve space while being capable of stably rotating the supply roller 27 and the developing roller 16.

(3) According to the developer cartridge 25 shown in FIG. 3, the developing-roller gear 54 is engaged with the developing-roller shaft 30 and incapable of rotating relative to the same. Therefore, the developing-roller gear 54 can reliably input a drive force into the developing-roller shaft 30 of the developing roller 16, achieving stable rotation of the developing roller 16.

(4) According to the developer cartridge 25 shown in FIG. 3, the second intermediate gear 57 is also engaged with the supply-roller gear 55 so as to be able to receive a drive force from the first intermediate gear 56 and transmit the drive force to the supply-roller gear 55. Accordingly, the second intermediate gear 57 can be used to transmit a drive force to the supply-roller gear 55 as well as the developing-roller gear 54.

(5) According to the developer cartridge 25 shown in FIG. 3, the second intermediate gear 57 includes the small-diameter part 62 engaged with the first intermediate gear 56, and the large-diameter part 61 engaged with the developing-roller gear 54 and supply-roller gear 55. Hence, when a drive force is transmitted from the first intermediate gear 56 to the small-diameter part 62, this drive force can be transmitted from the large-diameter part 61 to the developing-roller gear 54 and supply-roller gear 55. In this way, through a simple construction it is possible to transmit a drive force reliably from the first intermediate gear 56 to the developing-roller gear 54 and the supply-roller gear 55.

(6) According to the developer cartridge 25 shown in FIG. 3, the first intermediate gear 56 has a larger outer diameter than the outer diameter of the supply-roller gear 55. Hence, by engaging the front edge (outer radial edge) of the first intermediate gear 56 with the input gear 53, the input gear 53 can be reliably separated from the supply-roller gear 55. Therefore, the first intermediate gear 56 can be reliably engaged with the input gear 53 while not engaging the supply-roller gear 55 with the input gear 53.

(7) According to the developer cartridge 25 shown in FIG. 3, the side wall 33 includes the input-gear support part 39 for supporting the input gear 53, and the second-intermediate-gear support part 40 for supporting the second intermediate gear 57. Therefore, the input gear 53 and second intermediate gear 57 can be supported on the side wall 33 using a simple construction.

(8) According to the developer cartridge 25 shown in FIG. 2(*b*), the cartridge frame 31 includes the developing-roller support part 37 for supporting the developing roller 16, and the supply-roller support part 38 for supporting the supply roller 27. Accordingly, the developing roller 16 and supply roller 27 can be supported in the cartridge frame 31 through a simple construction.

(9) According to the developer cartridge 25 shown in FIG. 3, the first intermediate gear 56 is formed thicker in the left-right direction than the supply-roller gear 55. This construction ensures that the gear teeth formed on the first intermediate gear 56 can have substantial width to receive a drive force from the input gear 53 with greater stability.

5. Second Embodiment

Figure 4:
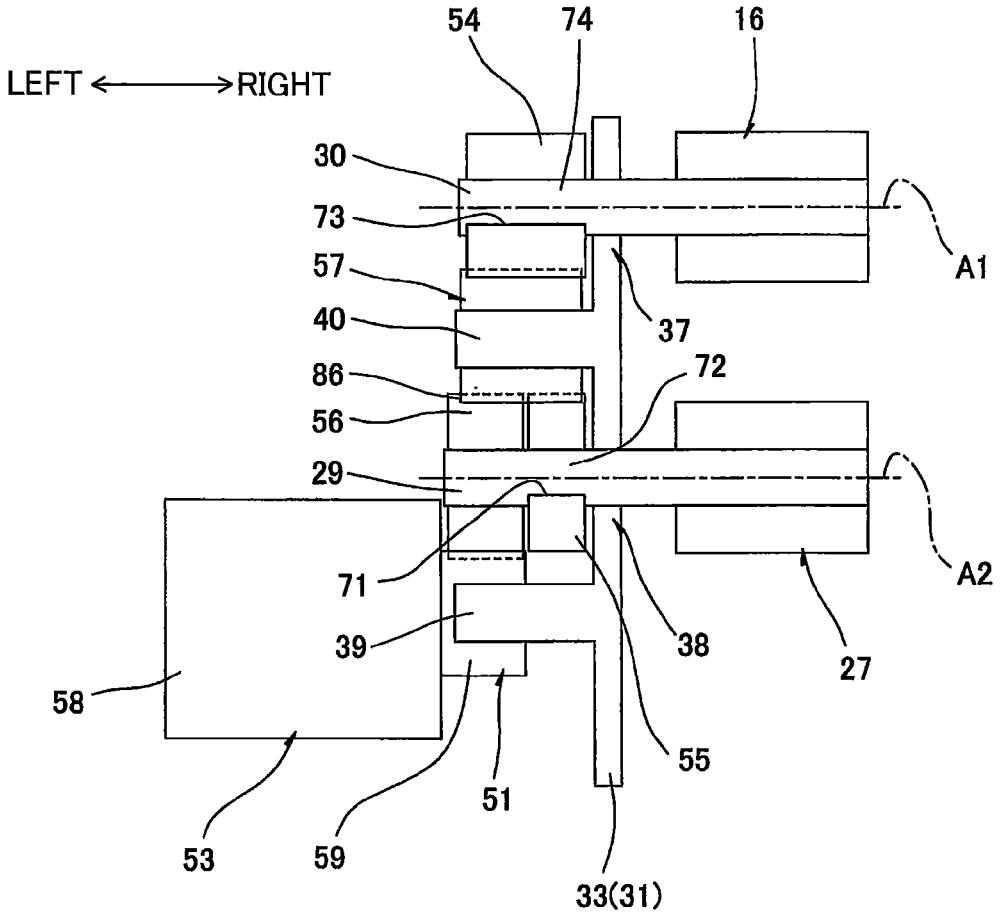
FIG. 4 is an explanatory diagram illustrating a drive transmission of a developer cartridge according to a second embodiment.

The printer 1 according to a second embodiment of the present invention will be described next with reference to FIG. 4, wherein like parts and components are designated with the same reference numerals to avoid duplicating description.

In the first embodiment described above, the supply-roller gear 55 is formed with a smaller diameter than the first intermediate gear 56, and the second intermediate gear 57 is a two-stage gear formed of the large-diameter part 61 and the small-diameter part 62. Here, the first intermediate gear 56 engages with the small-diameter part 62 of the second intermediate gear 57, and the supply-roller gear 55 and the developing-roller gear 54 engage with the large-diameter part 61 of the second intermediate gear 57.

However, in the second embodiment, the supply-roller gear 55 is formed with the same diameter as the first intermediate gear 56. The second intermediate gear 57 has a generally cylindrical shape that extends in the left-right direction. A gear part 86 that is wide in the left-right direction is formed around the peripheral surface of the second intermediate gear 57.

With this construction, the first intermediate gear 56 engages with the left half of the gear part 86 constituting the second intermediate gear 57, and the supply-roller gear 55 and developing-roller gear 54 engage with the right half of the gear part 86.

As in the first embodiment described above, a drive force is transmitted to both the developing-roller gear 54 and the supply-roller gear 55 in the second embodiment. Specifically, when a drive force is inputted from the main casing 2 into the input gear 53, the input gear 53 is driven to rotate and transmits the drive force to the first intermediate gear 56 via the gear part 59.

Consequently, the drive force is transmitted sequentially via the first intermediate gear 56, the second intermediate gear 57, and the developing-roller gear 54 and inputted into the developing-roller shaft 30 to rotate the developing roller 16. Similarly, the drive force is transmitted sequentially via the first intermediate gear 56, the second intermediate gear 57, and the supply-roller gear 55 and inputted into the supply-roller shaft 29 to rotate the supply roller 27.

In the second embodiment, the first intermediate gear 56, the developing-roller gear 54, and the supply-roller gear 55 are all engaged with the gear part 86 of the second intermediate gear 57. With the first intermediate gear 56, the developing-roller gear 54, and the supply-roller gear 55 coupled only to the gear part 86 of the second intermediate gear 57, this configuration enables the drive force to be transmitted using fewer parts.

In the second embodiment, the first intermediate gear 56 has the same diameter as the supply-roller gear 55. Accordingly, the first intermediate gear 56 and the supply-roller gear 55 occupy the same amount of space when projected in the left-right direction. Accordingly, this configuration efficiently arranges the first intermediate gear 56 and the supply-roller gear 55.

The printer 1 according to the second embodiment can achieve the same operational advantages as described in the first embodiment.

6. Third Embodiment

Figure 5:
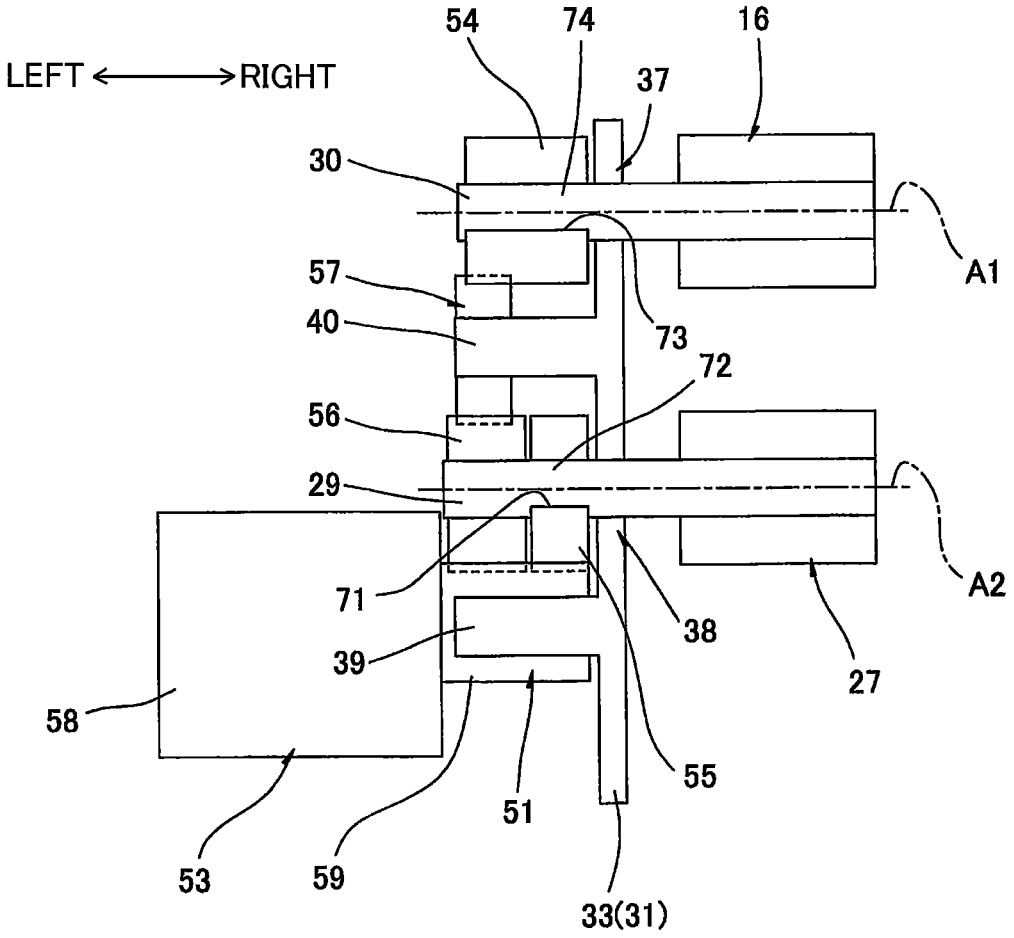
FIG. 5 is an explanatory diagram illustrating a drive transmission of a developer cartridge according to a third embodiment.

The printer 1 according to a third embodiment of the present invention will be described next with reference to FIG. 5, wherein like parts and components are designated with the same reference numerals to avoid duplicating description.

In the first embodiment described above, the supply-roller gear 55 is formed with a smaller diameter than the first intermediate gear 56, and the second intermediate gear 57 is a two-stage gear formed of the large-diameter part 61 and small-diameter part 62. Here, the first intermediate gear 56 engages with the small-diameter part 62 of the second intermediate gear 57, and the supply-roller gear 55 and the developing-roller gear 54 engage with the large-diameter part 61 of the second intermediate gear 57.

However, in the third embodiment, the supply-roller gear 55 is formed with the same diameter as the first intermediate gear 56. In addition, the second intermediate gear 57 is formed thinner in the left-right direction in order to engage the first intermediate gear 56 but not the supply-roller gear 55.

With this construction, the first intermediate gear 56 engages with the left half of the gear part 59 constituting the input gear 53, and the supply-roller gear 55 engages with the right half of the gear part 59. The first intermediate gear 56 and developing-roller gear 54 are engaged with the second intermediate gear 57.

In the third embodiment, when a drive force is inputted from the main casing 2 into the input gear 53, the input gear 53 rotates and transmits the drive force to the supply-roller gear 55 and first intermediate gear 56 via the gear part 59. Consequently, the supply-roller gear 55 inputs the drive force into the supply-roller shaft 29 to rotate the supply roller 27.

The first intermediate gear 56 is driven to rotate about the central axis A2 of the supply-roller shaft 29. At this time, the first intermediate gear 56 freely rotates relative to the supply-roller shaft 29. In other words, the first intermediate gear 56 does not transmit a drive force to the supply-roller shaft 29.

When the first intermediate gear 56 is driven to rotate, a drive force is transmitted to the second intermediate gear 57 engaged with the first intermediate gear 56 for rotating the second intermediate gear 57. Consequently, the drive force is transmitted to the developing-roller gear 54 engaged with the second intermediate gear 57 to rotate the developing-roller gear 54. The developing-roller gear 54 in turn inputs the drive force into the developing-roller shaft 30 to rotate the developing roller 16.

With the configuration of the third embodiment, the drive force can be transmitted directly from the input gear 53 to the supply roller 27, thereby rotating the supply roller 27 with greater stability.

In the third embodiment, the first intermediate gear 56 has the same diameter as the supply-roller gear 55. Accordingly, the first intermediate gear 56 and the supply-roller gear 55 occupy the same amount of space when projected in the left-right direction. Accordingly, this configuration efficiently arranges the first intermediate gear 56 and supply-roller gear 55.

While the invention has been described in detail with reference to the embodiments thereof, it would be apparent to those skilled in the art that various changes and modifications may be made therein without departing from the spirit of the invention.

What is claimed is:

1. A developer cartridge comprising:

a developing roller comprising a developing roller shaft extending in a first direction;

a supply roller comprising a supply roller shaft, the supply roller being in contact with the developing roller;

a gear configured to receive an external drive force;

a first intermediate gear provided to the supply roller shaft such that the first intermediate gear is rotatable relative to the supply roller shaft, the first intermediate gear being engaged with the gear;

a second intermediate gear engaged with the first intermediate gear;

a developing roller gear provided to the developing roller shaft such that the developing roller gear is unrotatable relative to the developing roller shaft, the developing roller gear being engaged with the second intermediate gear; and a supply roller gear provided to the supply roller shaft such that the supply roller gear is unrotatable relative to the supply roller shaft, the supply roller gear being engaged with the second intermediate gear.

2. The developer cartridge according to claim 1, wherein the gear has a coupling part configured to receive the external drive force and a gear part engaged with the first intermediate gear, the coupling part having a fitting recess which is recessed in the first direction.

3. The developer cartridge according to claim 1, wherein the supply roller shaft has a support part having a D-shape cross section, wherein the supply roller gear has a fitting hole having a D-shape cross section, and wherein the supply roller gear is fitted over the support part at the fitting hole.

4. The developer cartridge according to claim 1, wherein the second intermediate gear comprises a first gear part engaged with the first intermediate gear and a second gear part engaged with both the developing roller gear and the supply roller gear.

5. The developer cartridge according to claim 4, wherein the first intermediate gear has a diameter larger than a diameter of the supply roller gear.

6. The developer cartridge according to claim 1, wherein the second intermediate gear comprises a gear part engaged with the first intermediate gear, the developing roller gear, and the supply roller gear.

7. The developer cartridge according to claim 6, wherein the first intermediate gear has a diameter the same as a diameter of the supply roller gear.

8. The developer cartridge according to claim 1, further comprising a developer frame configured to accommodate developing agent therein, the developer frame comprising a pair of side walls confronting each other in the first direction, wherein one of the pair of side walls comprises a first support portion supporting the gear and a second support portion supporting the second intermediate gear.

9. The developer cartridge according to claim 8, wherein the developer frame comprises a developing roller support part supporting the developing roller, and a supply roller support part supporting the supply roller.

10. The developer cartridge according to claim 1, wherein the first intermediate gear has a thickness in the first direction thicker than that of the supply roller gear.

11. The developer cartridge according to claim 1, wherein the first intermediate gear is directly provided on the supply roller shaft, wherein the developing roller gear is directly provided on the developing roller shaft, and wherein the supply roller gear is directly provided on the supply roller shaft.

* * * * *